US006103297A

United States Patent [19]

Aoki et al.

[11] Patent Number: 6,103,297

[45] Date of Patent: Aug. 15, 2000

[54] METHOD OF MANUFACTURING CATHODE-RAY TUBE

[75] Inventors: Nobuyuki Aoki, Osaka; Kenji Nakada, Tochigi; Naoyuki Tani; Hiroshi Deguchi, both of Osaka, all of Japan

[73] Assignee: Matsushita Electronics Corporation, Osaka, Japan

[21] Appl. No.: 09/216,988

[22] Filed: Dec. 21, 1998

[30] Foreign Application Priority Data

Jan. 14, 1998 [JP] Japan ..... 10-005617

[51] Int. Cl.[7] ..... B05D 5/12

[52] U.S. Cl. ..... 427/72; 427/64; 427/68; 427/240

[58] Field of Search ..... 427/64, 68, 240, 427/72, 346

[56] References Cited

U.S. PATENT DOCUMENTS

| | | | |
|---|---|---|---|
| 3,653,941 | 4/1972 | Bell et al. | 427/72 |
| 4,078,095 | 3/1978 | Ratay | 427/72 |
| 4,254,160 | 3/1981 | Raih | 427/72 |

FOREIGN PATENT DOCUMENTS

| | | |
|---|---|---|
| 0 477 980 | 4/1992 | European Pat. Off. . |
| 2 083 991 | 12/1971 | France . |
| 41 05 297 | 8/1992 | Germany . |
| 55-57230 | 4/1980 | Japan . |
| 59-186230 | 10/1984 | Japan . |
| 3-122944 | 5/1991 | Japan . |
| 3-230451 | 10/1991 | Japan . |
| 5-101775 | 4/1993 | Japan . |
| 06 203752 | 7/1994 | Japan . |
| 2 236 428 | 4/1991 | United Kingdom . |

OTHER PUBLICATIONS

Derwent Publications Ltd., Section Ch, Week 9306, Class L03, AN 93–050954 & KR 9 203 963 (Samsung Electron Devices), May 18, 1992.

*Primary Examiner*—Janyce Bell
*Attorney, Agent, or Firm*—Merchant & Gould P.C.

[57] ABSTRACT

A method of manufacturing a cathode-ray tube comprises a process of forming a phosphor screen. The process comprises an application process, a shake-off process, and a drying process. In the application process, a glass panel is tilted with respect to a vertical axis and is rotated having a tilt axis as a central axis to spread a phosphor slurry over almost the entire area of an inner face of the glass panel. In the shake-off process, by rotating the glass panel, excess phosphor slurry is shaken off, and the excess phosphor slurry is recovered in phosphor-slurry recovery members provided at the four corners of the glass panel. In the drying process, the phosphor slurry is dried. In this method, the tilt angle and rotation speed of the glass panel at least in one process out of the application process, the shake-off process, and the drying process is changed at least in two stages. Thus, using large phosphor particles capable of obtaining a high luminance, a cathode-ray tube in which a phosphor screen, with uniform distribution of the phosphors and without a cross phenomenon, wall stain, and liquid spill onto the inner face, is formed on an inner face of a glass panel can be obtained.

13 Claims, 7 Drawing Sheets

METHOD OF MANUFACTURING CATHODE-RAY TUBE

FIELD OF THE INVENTION

The present invention relates to a method of manufacturing a cathode-ray tube (hereafter referred to as a "CRT") such as a color cathode-ray tube. Particularly, the present invention relates to a method of forming a uniform phosphor screen on an inner face of a glass panel of a CRT for a computer monitor (hereafter referred to as a "CMT") or the like that requires a high luminance.

BACKGROUND OF THE INVENTION

Conventionally, a CRT has been used widely as a display unit for displaying characters and pictures by exciting phosphors using electron beams. Generally, in a phosphor screen formed on an inner face of a glass panel of the CRT, three kinds of phosphor pixels that emit red, green, and blue lights respectively are arranged regularly as dots or in a stripe shape via a photoabsorption film referred to as a black matrix.

Such a phosphor screen can be obtained by: forming a photosensitive resin film on an inner face of a glass panel of a CRT; forming phosphor-formation cites at positions where phosphor pixels are formed on the photosensitive resin film by applying, exposing, and developing a photoreactive substance using a photolithographic technique; subsequently applying a phosphor suspension on the inner face of the glass panel; and forming respective phosphors of blue, green, and red by repeating the same photolithographic technique.

As an application process for forming a phosphor screen of a CRT, a method of applying a phosphor slurry prepared by suspending phosphors in photosensitive resin while a glass panel is rotated with a tilt is mainly employed. The processes described below are carried out by a continuous looped machine sequentially, a mill machine operated in a circular manner, or the like.

As a first step, a phosphor slurry is injected onto an inner face of a glass panel rotating at a low speed. While the injected phosphor slurry is spread over the inner face slowly due to the inclination and rotation of the glass panel, phosphor particles are precipitated (an application process). In a process of applying phosphors, it is important to obtain a phosphor screen with a uniform thickness and without unevenness in an application condition. For that purpose, some methods such as a method of changing a tilt angle of a glass panel periodically by synchronizing with a rotation period of the glass panel (for example, Publication of Japanese Unexamined Patent Application No. Hei 3-122944) and a method of rotating a glass panel by positive rotation and reverse rotation (for instance, Publication of Japanese Unexamined Patent Application No. Hei 5-101775) are proposed.

As a subsequent step of the application process, excess phosphor slurry is shaken off by increasing the rotation speed of the glass panel (a shake-off process). In order to obtain a uniform phosphor screen, setting of a tilt angle and a rotation speed of the glass panel are important in shaking-off the excess phosphor slurry. A method of shaking-off with a glass panel being oblique and facing upward (for example, Publication of Japanese Unexamined Patent Application No. Sho 55-57230), a method of shaking-off with a glass panel being oblique and facing downward (for example, Publication of Japanese Unexamined Patent Application No. Sho 59-186230), and the like have been proposed. Excess phosphor slurry is recovered in an external fluid-recovery pan that is provided beside a glass panel head in a high-speed shake-off process or is recovered in corner cups that are positioned at the four corners of a glass panel and are provided on a stage fixed to the glass panel in a swivel head part.

After shaking off the excess phosphor slurry, the phosphor screen is dried by an infrared heater from the outside (a drying process). Then a shadow mask is set, and the phosphor screen is exposed with ultraviolet rays. A light cross-linking reaction between photosensitive resin and a sensitizing initiator progresses by the irradiation of the ultraviolet rays, thus making the exposed parts insoluble in water. After the exposure, the shadow mask is removed, and development is carried out using a warm water shower or the like. As a result, unexposed parts are washed away by the water and phosphor patterns are formed only in necessary parts.

Recently, a display for a CMT is required to have a high luminance and high resolution over the entire part of a display screen on a glass panel. For this purpose, some methods, for example, a method of making a high luminance and high contrast compatible by providing a filter having the same color as respective color at the color-formation sites in a phosphor screen and combining with a high-transmission glass panel, and a method of improving reflectance by controlling a pigment concentration of phosphors having pigments that are coated with the same color minute pigment particles on the phosphors themselves used for forming a phosphor screen have been proposed.

As a method of forming a phosphor screen, there is a method of improving luminous efficiency by using phosphor particles with a large particle size. On the contrary, there is a method of obtaining a higher luminance by filling minute phosphors particles at high density. When phosphor particles with a large particle size are used, a drying method by low-speed rotation is employed in order to avoid the occurrence of a so-called cross phenomenon (nonuniformity in thickness due to the influence of a base) of phosphors during the formation of a phosphor screen. On the other hand, when minute phosphor particles are used, considering efficient recovery of the phosphor particles, a drying method by middle- to high-speed rotation is employed (for example, Publication of Japanese Unexamined Patent Application No. Hei 3-230451).

In a method of recovering excess phosphor slurry in corner cups provided at the four corners of a glass panel as described above, in the case of using phosphors having a large particle size beyond 5 $\mu$m, when the rotation speed of the glass panel is too low, the centrifugal force decreases. As a result, in a drying process in forming a phosphor screen, the recovered phosphor slurry spatters from the corner cups to the outside. Therefore, in order to restrain the spatter, the glass panel requires to be rotated at high speed. However, the high-speed rotation causes the above-mentioned cross phenomenon.

On the contrary, in order to avoid the cross phenomenon, it is necessary to make the rotation speed of the glass panel as low as possible. However, when decreasing the rotation speed, the recovered phosphor slurry spatters from the corner cups to the outside. Therefore the surroundings get dirty, thus inducing defects in partially-processed articles. As described above, there are conflicting requirements as to the rotation speed of the glass panel. Consequently, there has been a problem that phosphors with a large particle size cannot be used for forming a phosphor screen to obtain a higher luminance.

From another point of view, as a method of forming a phosphor screen employing a drying process by a low-speed rotation, there is a method of recovering excess phosphor slurry in a recovery pan provided outside a head by driving each head intermittently. However, there have been problems such as great increase in the size of equipment and the complexity of a system controlling each process.

SUMMARY OF THE INVENTION

The present invention aims to solve the foregoing problems. It is an object of the present invention to provide a method of manufacturing a cathode-ray tube in which a phosphor screen with a uniform thickness and filling rate can be formed using large phosphor particles with which a high luminance can be obtained and excess phosphor slurry can be recovered efficiently.

A method of manufacturing a cathode-ray tube of the present invention comprises a process of forming a phosphor screen. The process comprises an application process, a shake-off process, and a drying process. In the application process, a phosphor slurry is injected onto an inner face of a glass panel and the glass panel is tilted with respect to a vertical axis and is rotated to spread the phosphor slurry over almost the entire area of the inner face of the glass panel. In the shake-off process, by rotating the glass panel with a tilt, excess phosphor slurry is shaken off, and the excess phosphor slurry is recovered in phosphor-slurry recovery members provided at the four corners of the glass panel. In the drying process, by rotating the glass panel with a tilt, the phosphor slurry applied onto the inner face of the glass panel is dried. In the method described above, the tilt angle and rotation speed of the glass panel at least in one process out of the application process, the shake-off process, and the drying process are changed at least in two stages.

According to the processes described above, it is possible to form a phosphor screen using large phosphor particles capable of obtaining a high luminance. A cross phenomenon, wall stain on an inner and outer faces of the glass panel, liquid spill onto the inner face of the glass panel, or the like can be avoided. Furthermore, the phosphor screen can be formed uniformly. Thus, a CRT that satisfies an abundant luminance variation, a high luminance, and high contrast can be provided, which has been impossible in a conventional method.

It is preferable that the application process comprises a first application step and a second application step. In the first application step, the glass panel is rotated at a predetermined tilt angle and a predetermined rotation speed. In the second application step subsequent to the first application step, the glass panel is rotated at a wider tilt angle than that in the first application step and a lower rotation speed than that in the first application step.

According to this method, in the first application step, the phosphor slurry is spread over almost the entire area of the inner face of the glass panel, and in the subsequent second application step, the phosphor slurry can be precipitated on the inner face of the glass panel.

It is preferable that the application process further comprises a third application step subsequent to the second application step. In the third application step, the glass panel is rotated at a lower rotation speed than that in the second application step.

According to this method, in the third application step, the phosphor slurry also can flow to the peripheral portion of the glass panel sufficiently. In addition, the phosphor slurry can spread over the entire surface of the glass panel very quickly, thus forming a uniform phosphor screen over the entire effective surface of the inner face of the glass panel.

In the first application step described above, it is preferable that the glass panel has a tilt angle of 5°–20°.

It is preferable that the shake-off process comprises a first shake-off step and a second shake-off step. In the first shake-off step, the glass panel is rotated at a predetermined tilt angle and a predetermined rotation speed. In the second shake-off step subsequent to the first shake-off step, the glass panel is rotated at a wider tilt angle than that in the first shake-off step and a higher rotation speed than that in the application process.

According to this method, in the first shake-off step, excess phosphor slurry is recovered in phosphor-slurry recovery members (corner cups) efficiently. In the subsequent second shake-off step, phosphor-screen distribution in forming the phosphor screen is equalized, thus restraining a phenomenon of the phosphor slurry sticking around a pin and staining a panel wall that occurs when the phosphor slurry flows into the parts other than the phosphor screen in the following processes.

It is preferable that the glass panel has a tilt angle of 40°–80° and a rotation speed of 100–150 rpm in the first shake-off step and the glass panel has a tilt angle of 65°–115° and a rotation speed of 150–250 rpm in the second shake-off step.

It is preferable that the drying process comprises a first drying step and a second drying step. In the first drying step, the glass panel is rotated at a predetermined tilt angle and a predetermined rotation speed. In the second drying step subsequent to the first drying step, the glass panel is rotated at an equal rotation speed to or at a higher rotation speed than that in the application process.

According to this method, in the first drying step, the recovered phosphor slurry is prevented from spattering outside the phosphor-slurry recovery members. In the subsequent second drying step, a uniform thickness of the phosphor screen formed of the phosphor slurry can be obtained. Thus, excess phosphor slurry recovered in the phosphor-slurry recovery members does not spatter outside during drying of the slurry. In addition, a cross phenomenon that causes defects in partially-processed articles can be solved. Therefore, large phosphor particles capable of obtaining a high luminance can be used. Further, liquid spill of the undried phosphor screen into the effective surface of the inner face of the glass panel and stain spreading over a panel-sealing surface can be reduced.

It is preferable that the glass panel has a tilt angle of 85°–95° and a rotation speed of 30–70 rpm in the first drying step and the glass panel has a tilt angle of 85°–95° and a rotation speed of 70–95 rpm in the second drying step.

Further, it is preferable that the application process comprises a first application step, a second application step, and a third application step, the shake-off process comprises a first shake-off step and a second shake-off step, and the drying process comprises a first drying step and a second drying step. In the first application step, the glass panel is rotated at a predetermined tilt angle and a predetermined rotation speed. In the second application step subsequent to the first application step, the glass panel is rotated at a wider tilt angle than that in the first application step and a lower rotation speed than that in the first application step. In the third application step subsequent to the second application step, the glass panel is rotated at a lower rotation speed than that in the second application step. In the first shake-off step, the glass panel is rotated at a predetermined tilt angle and a predetermined rotation speed. In the second shake-off step subsequent to the first shake-off step, the glass panel is rotated at a wider tilt angle than that in the first shake-off step and a higher rotation speed than that in the first application step. In the first drying step, the glass panel is rotated at a predetermined tilt angle and a predetermined rotation speed. In the second drying step subsequent to the first drying step, the glass panel is rotated at an equal rotation speed to or at a higher rotation speed than that in the first application step.

According to this method, by using corner cups having excellent recovery efficiency as phosphor-slurry recovery members, the phosphor screen can be formed with large phosphor particles having a high luminance. Consequently, a cross phenomenon, wall stain on inner and outer faces of the glass panel, liquid spill onto the inner face of the glass panel, or the like can be prevented. Furthermore, the phosphor screen can be formed uniformly. Thus, a CRT that provides an abundant luminance variation, a high luminance, and high contrast can be provided, which has been impossible in a conventional method.

It is further preferable that each phosphor-slurry recovery member described above is a box-shaped object with an opening and has turn-up portions toward the inside of the box-shaped object at the edge of the opening.

Accordingly, the excess phosphor slurry that has been recovered once does not spatter outside the phosphor-slurry recovery members.

DETAILED DESCRIPTION OF THE INVENTION

A specific example of processes of forming a phosphor screen used in a CMT with a size of 41 cm (17 inches) will be explained as follows.

First Embodiment

Figure 1:
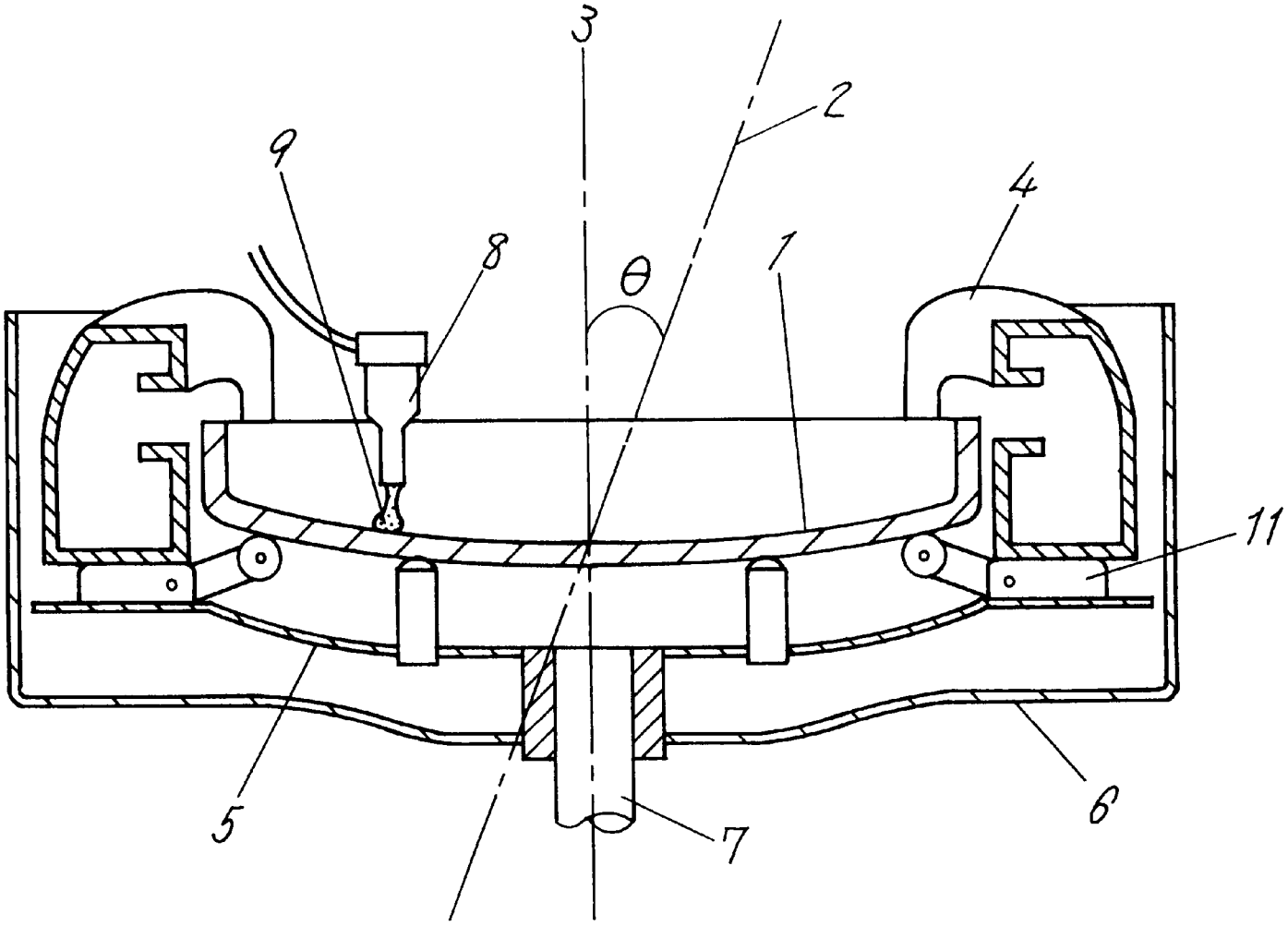
FIG. 1 is a schematic side cross-sectional view of a phosphor-screen formation device used in phosphor-screen formation processes according to the present invention.

FIG. 1 is a side cross-sectional view of a phosphor-screen formation device used in phosphor-screen formation processes according to a first embodiment of the present invention.

As shown in FIG. 1, a glass panel 1 on which a black matrix has been formed is positioned at a predetermined tilt angle θ (hereafter referred to as "a panel-tilt angle θ") with respect to a vertical axis 2. Then a phosphor slurry 9 discharged from an application nozzle 8 is injected onto the inner face of the glass panel 1. In this case, a panel tilt axis 3 is orthogonal to a tangent line at the center of the glass panel 1 and coincides with a tube axis of the CRT. The glass panel 1 is installed on a turning base 5 and is rotated by the rotation of a rotation axis 7 having the tilt axis 3 as the central axis.

Figure 2:
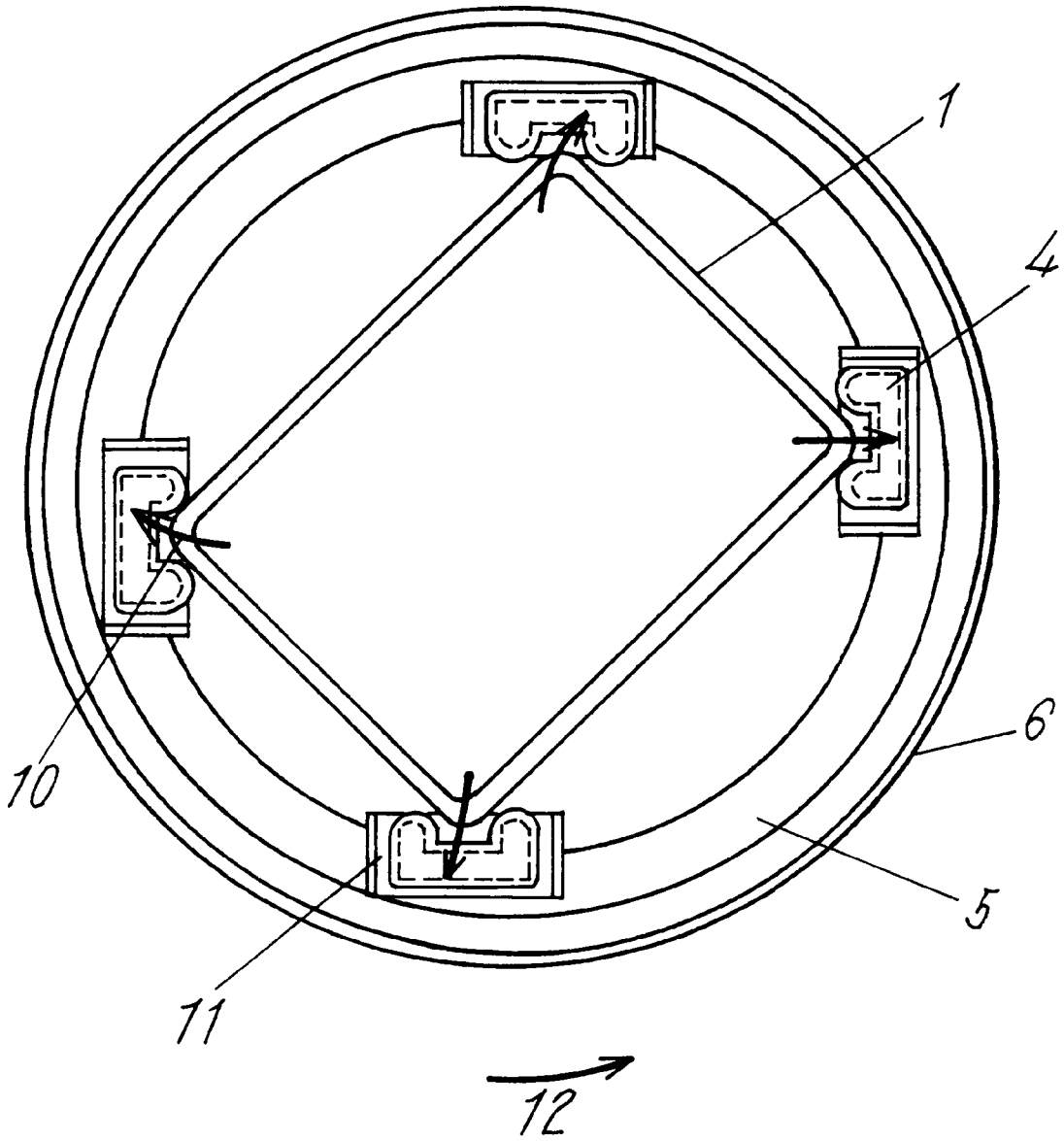
FIG. 2 is a schematic plan view of the phosphor-screen formation device.

As shown in FIG. 2, corner cups 4 as phosphor-slurry recovery members are provided at the four corners of the glass panel 1 respectively. The corner cups 4 are designed so as to be moved by a cup-clump axis 11 in inserting and removing the glass panel 1. The parts described above are combined with an outer stage 6 into one unit, thus obtaining a phosphor-screen formation device.

Figure 3:
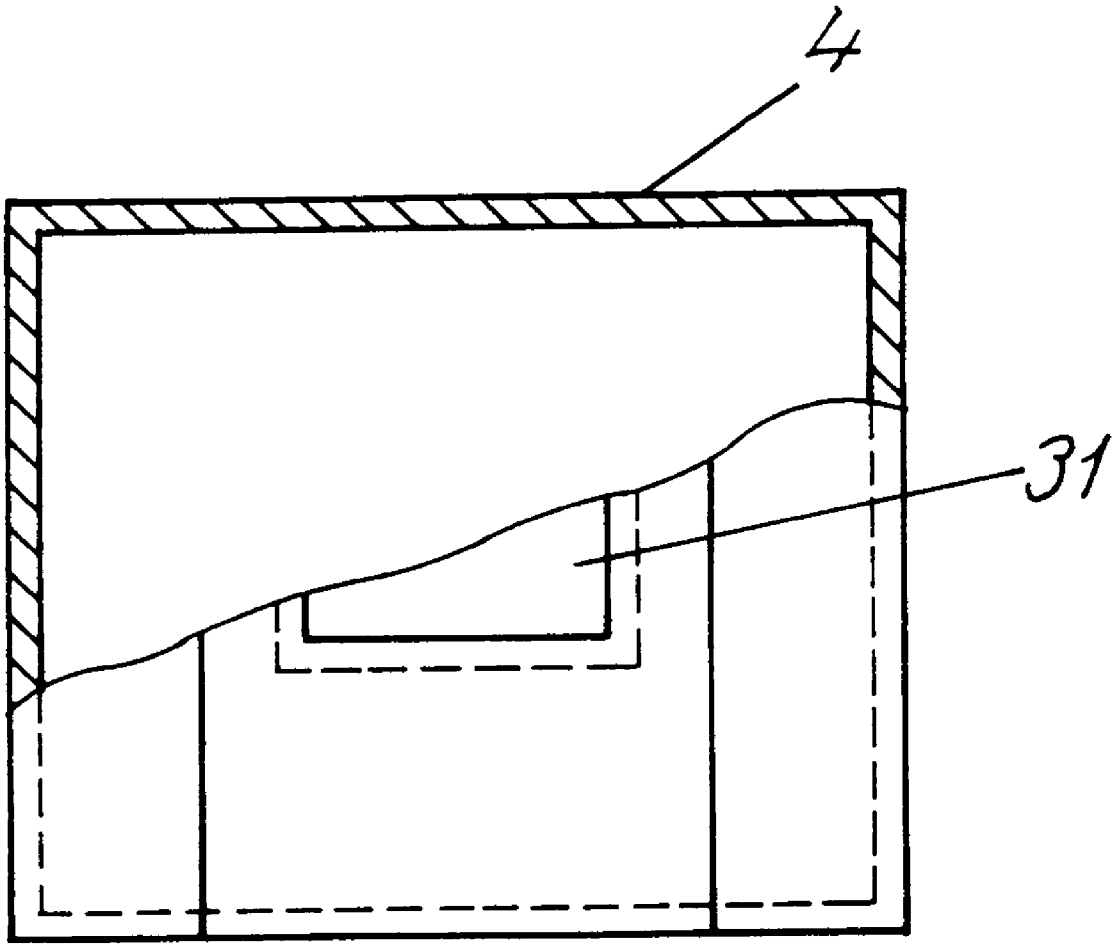
FIG. 3 is a partially cutaway front view of a corner cup for recovering a phosphor slurry according to the present invention.
Figure 4:
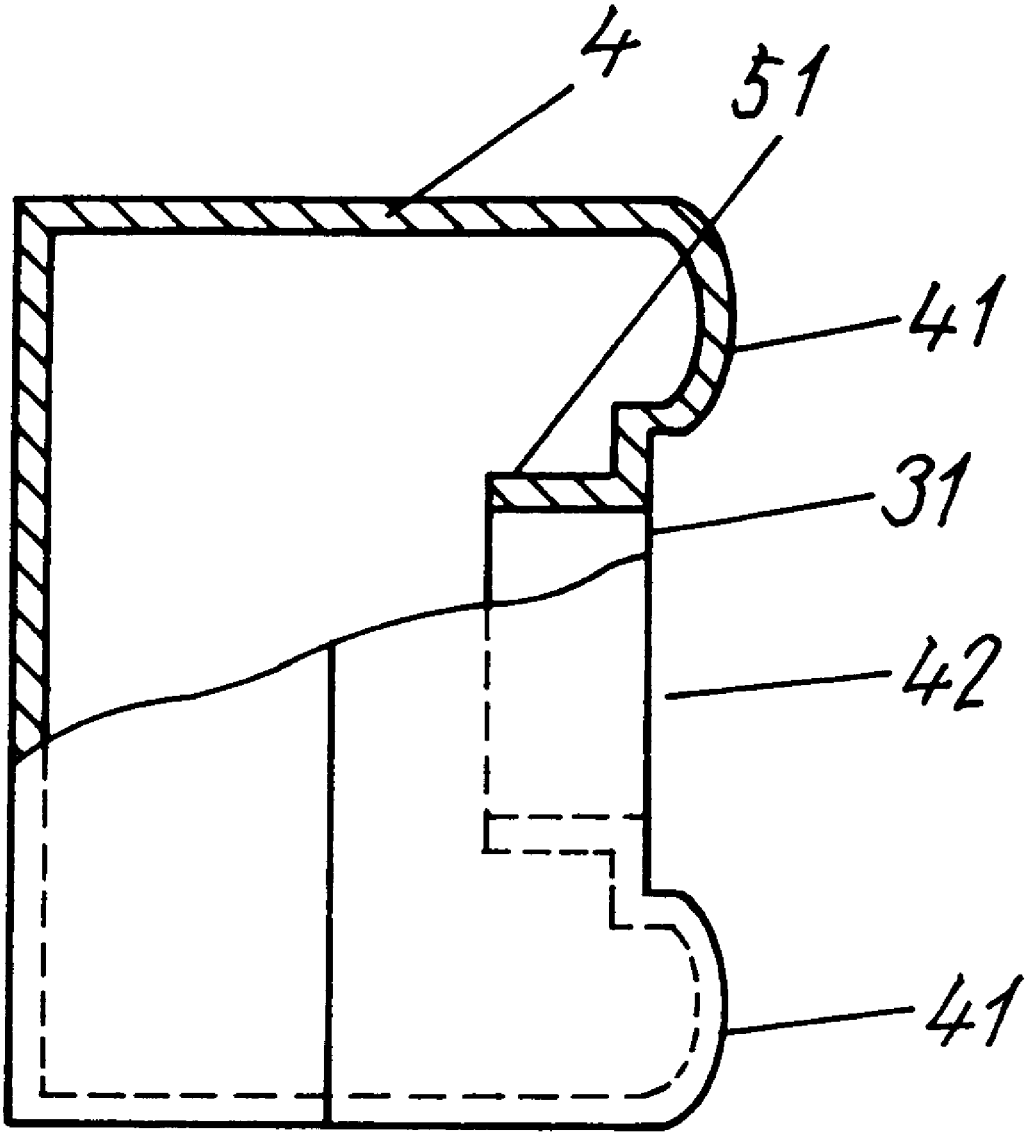
FIG. 4 is a partially cutaway plan view of the corner cup.
Figure 5:
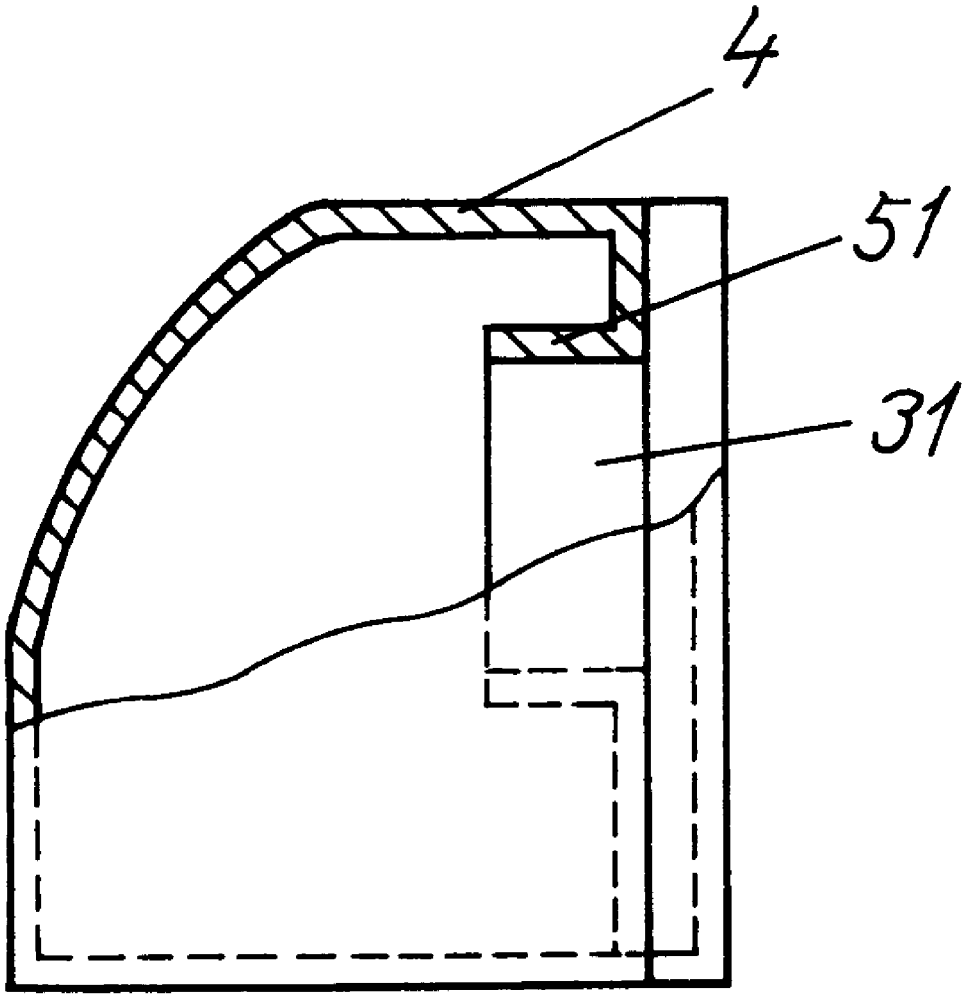
FIG. 5 is a partially cutaway side view of the corner cup.

FIG. 3 is a partially cutaway front view of a corner cup 4 (an opening side), FIG. 4 is a partially cutaway plan view, and FIG. 5 is a partially cutaway left side view. As shown in FIGS. 3–5, the corner cup 4 has square and cylindrical turn-up portions 51 toward the inside of the corner cup 4 at edges of an opening 31. The corner cup 4 receives excess phosphor slurry that is shaken off by the rotation of the glass panel 1. The corner cup 4 is designed so that the recovered phosphor slurry is difficult to spatter outside the corner cup 4. Since the corner cup 4 is designed so that a concave part 42 formed between two convex parts 41 holds an corner of the glass panel 1 inside, the phosphor slurry is prevented from spattering, resulting in secure recovery.

The phosphor slurry 9 of green phosphors is prepared using the following materials.

| | |
|---|---|
| Copper active zinc sulphide phosphors (with a particle size of 8 μm) | 25 wt % |
| Polyvinylalcohol resin | 2.5 wt % |
| Ammonium dichromate | 0.25 wt % |
| Surfactant | 0.03 wt % |
| Antifoaming agent | 0.02 wt % |
| Water | 72.2 wt. % |

The above-mentioned materials are mixed by a propeller mixer and then are dispersed using a disperser for a fixed period. Ammonium dichromate and ammonia are added to the prepared phosphor slurry so as to provide a pH in a range of 7–9. In order to increase adhesive strength of the phosphors, a hardener (for instance, Primal C-72 manufactured by ROHM AND HAAS COMPANY or the like) may be added or a ball mill process may be carried out.

Using the phosphor slurry 9 prepared as described above, a predetermined phosphor screen is formed on an inner face of the glass panel 1 on which a black matrix has been formed through a two-step application process, a shake-off process, and a two-step drying process as described below.

About 30 cc of the phosphor slurry 9 delivered from the application nozzle 8 are injected onto the inner face of the glass panel 1. As shown in FIG. 1, while the glass panel 1 is tilted with respect to a vertical axis 2, the phosphor slurry 9 is spread over the entire surface of the glass panel 1 and then phosphor particles are sufficiently precipitated (a first application step). In this case, when the amount of phosphor slurry to be injected is too much, foam is generated easily due to spatter of the slurry at a peripheral portion of the glass panel 1. On the contrary, when the amount of phosphor slurry to be injected is too little, the slurry cannot be applied to an effective surface of the inner face of the glass panel 1 sufficiently. Therefore, the amount is preferably 7–40 cc in the case of a 41-cm glass panel, and the optimum amount is 28–35 cc.

The first application step employs a panel-tilt angle θ of 10° and a rotation speed (hereafter referred to as "panel rotation speed") of 13 rpm when the glass panel 1 is rotated having the panel-tilt axis 3 as the center of rotation. In this case, when the panel-tilt angle θ is too wide, foam is generated. On the contrary, when the panel-tilt angle θ is too narrow, the phosphor slurry 9 does not spread over the inner face of the glass panel 1 sufficiently. Therefore, it is preferable that the panel-tilt angle θ is about 5°–15°, and more preferably 10°. In this embodiment, the glass panel 1 is rotated counterclockwise with respect to the turning base 5 with the inner face of the glass panel 1 facing upward. However, the condition is not limited to this.

As a next step, while the panel-tilt angle θ is changed to 23°, the phosphor slurry 9 is caused to flow to the peripheral portion of the glass panel 1 and to precipitate phosphor particles in the phosphor slurry 9 sufficiently at a panel rotation speed of 5 rpm (a second application step). In the second application step, the panel rotation speed is set to a rotation speed at which the phosphor slurry 9 can flow to the peripheral portion of the inner face of the glass panel 1 sufficiently.

Then, the panel-tilt angle θ is changed to 110° with respect to the vertical axis 2 rapidly, and the panel rotation speed is increased to 190 rpm at the same time. As shown in FIG. 2, excess phosphor slurry is shaken off and recovered in the corner cups 4, and the surface on which the phosphor slurry has been applied is smoothed (a shake-off process). In the shake-off process, considering the uniformity of the phosphor screen and stain caused by spatter of the phosphor slurry, the panel-tilt angle θ is preferably 65°–115°. The panel rotation speed is preferably in the range of about 150–250 rpm. As shown in FIG. 2, spattering directions 10 of the excess phosphor slurry are opposite to the rotation direction 12 of the glass panel 1 relative to the tilt axis 3.

Subsequently, the panel-tilt angle θ is changed to 90° and the panel rotation speed is decreased to 50 rpm. The phosphor slurry applied on the inner face of the glass panel 1 is dried by an outside infrared heater (a drying process). At that time, in order to shorten the drying time, hot air may be blasted onto the inner face of the glass panel 1 in addition to the heating by the infrared heater. In this drying process, the panel-tilt angle θ is preferably 85°–95°, and more preferably 90°. However, when a second-color or third-color phosphor screen is formed, there is an influence of the presence of the base. Therefore, it is necessary to increase the panel-tilt angle θ compared to that when forming a first-color phosphor screen. In that case, the panel-tilt angle θ is more preferably 91°.

The panel rotation speed in the drying process is preferably 30–70 rpm in a first drying step and 70–-95 rpm in a second drying step subsequent to the first drying step. In the first drying step, the phosphor screen on the inner face of the glass panel 1 starts drying and the drying proceeds over almost the entire area of the effective surface of the glass panel 1. When a phosphor screen of second or later colors is formed, it is more preferable that the panel rotation speed in the first drying step is 30–40 rpm.

A shadow mask is mounted to the glass panel on which green phosphors are applied and then dried according to the above-mentioned processes. Then the glass panel is exposed to ultraviolet rays and is developed, thus forming a phosphor screen formed of green phosphors. The phosphor screen obtained under the manufacturing conditions described above has a dot size of 145 μm at the center portion and 147 μm at the peripheral portion. Adhesion of the green phosphors to holes for the other colors (on the glass surface) was not found on the inner face of the glass panel. When adhesive strength of the phosphors is weak, the entire surface may be exposed to UV-rays with weak illumination from the outer face of the glass panel.

As a next step, a phosphor screen formed of blue phosphors and a phosphor screen formed of red phosphors are formed sequentially by the same processes as those used for forming the phosphor screen formed of the green phosphors. With respect to the order of forming the phosphor screens, the phosphor screens formed of green, blue, and red phosphors are formed sequentially in this embodiment. However, they may be formed in the order of the phosphor screens formed of blue, green, and red phosphors. The order is not limited to those mentioned above as long as a cathode-ray tube meets the standards as to white quality, color difference, and the like. However, when considering unevenness in application or color mixture, it is preferable to employ either order mentioned above.

The phosphor screen obtained by the above-mentioned method had a dot size of 144 μm at the center portion and 146 μm at the peripheral portion as to the blue phosphors. Regarding red phosphors, the phosphor screen had a dot size of 143 μm at the center portion and 146 μm at the peripheral portion. The blue and red phosphor particles adhering to back faces of the green phosphors were about one or two per a length of 200 μm. Moreover, the red phosphors adhering to back faces of the blue phosphors were hardly observed.

Subsequently, a film of an acrylic emulsion solution (B-74 manufactured by ROHM AND HAAS COMPANY) is formed on the phosphor screen by the same procedure as that used for applying and drying the phosphor slurry. In that case, the panel-tilt angle is the same as that in the case of the phosphors, and a 10 rpm panel self-rotation speed is employed for all the processes except the shake-off process. Then, an aluminum film is formed by aluminum evaporation. Finally, the shadow mask, a funnel, a magnetic shielding, and the like are incorporated and an electron gun is enclosed, thus obtaining a cathode-ray tube (a finished bulb) after being evacuated.

The characteristics, the performance evaluation and the like of the phosphor screen and the cathode-ray tube obtained in this embodiment will be described later.

Second Embodiment

In this embodiment, a third application step is added to an application process and a shake-off process comprises two steps of a first shake-off step and a second shake-off step.

In a first application step employing a panel-tilt angle θ of 5° and a panel rotation speed of 8 rpm and in a second application step employing a panel-tilt angle θ of 28° and a panel rotation speed of 6 rpm, phosphor particles are spread over the entire effective surface of an inner face of a glass panel and are sufficiently precipitated. Further, by decreasing the panel rotation speed to 5 rpm in the third application step, a phosphor slurry is caused to flow sufficiently to a peripheral portion of the inner face of the glass panel.

As the shake-off process, in the first shake-off step employing a panel-tilt angle θ of 50° and a panel rotation speed of 110 rpm, excess phosphor slurry is recovered in corner cups. In this case, the narrower the panel-tilt angle θ is, the less stain on the glass panel is caused. However, uniformity in film thickness of the phosphor screen cannot be maintained. Therefore, the panel-tilt angle θ is preferably about 40°–80°, more preferably around 50°. The panel rotation speed is preferably 100–150 rpm.

Subsequently, in the second shake-off step, by changing the panel-tilt angle θ to 110° and increasing the panel rotation speed to 180 rpm, excess phosphor slurry is shaken off and the surface on which the phosphor slurry has been applied is smoothed. In this case, preferably the panel-tilt angle θ is 65°–115° and the panel rotation speed is 150–250 rpm.

The subsequent drying process and the further process are the same as in the first embodiment. Thus a phosphor screen is formed.

Third Embodiment

Figure 6:
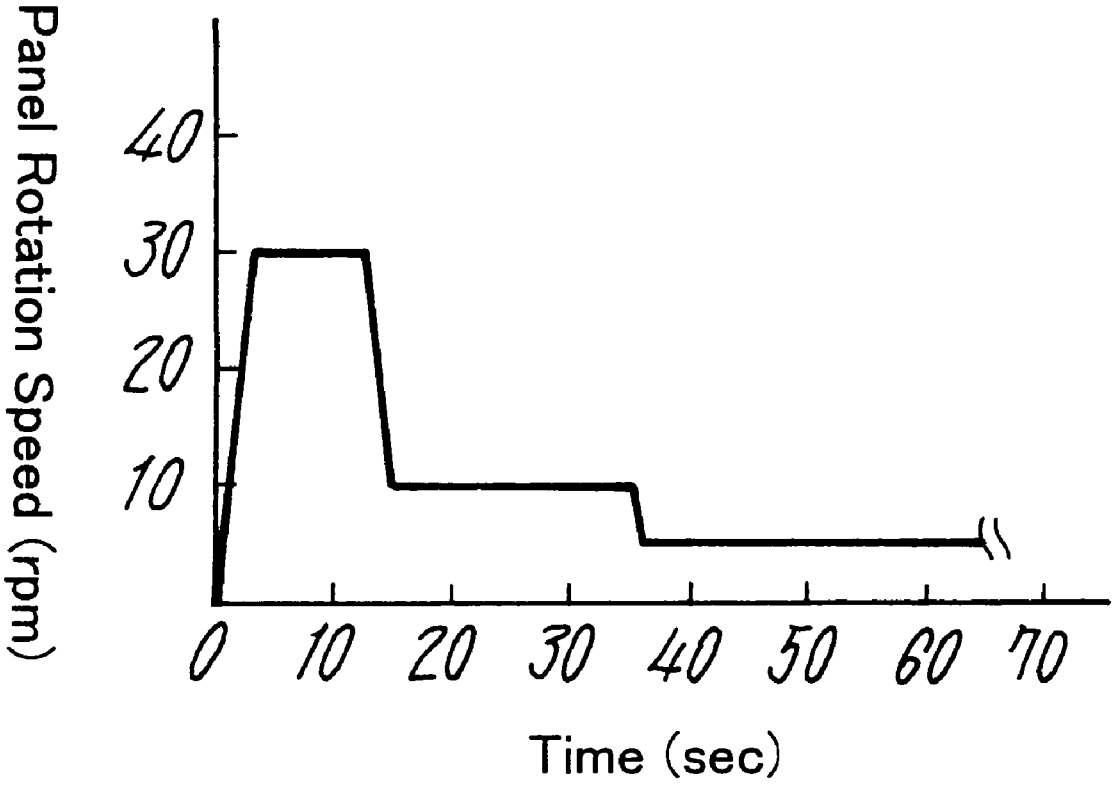
FIG. 6 is a graph showing the relationship between time and a panel rotation speed in an application process according to a third embodiment of the present invention.
Figure 7:
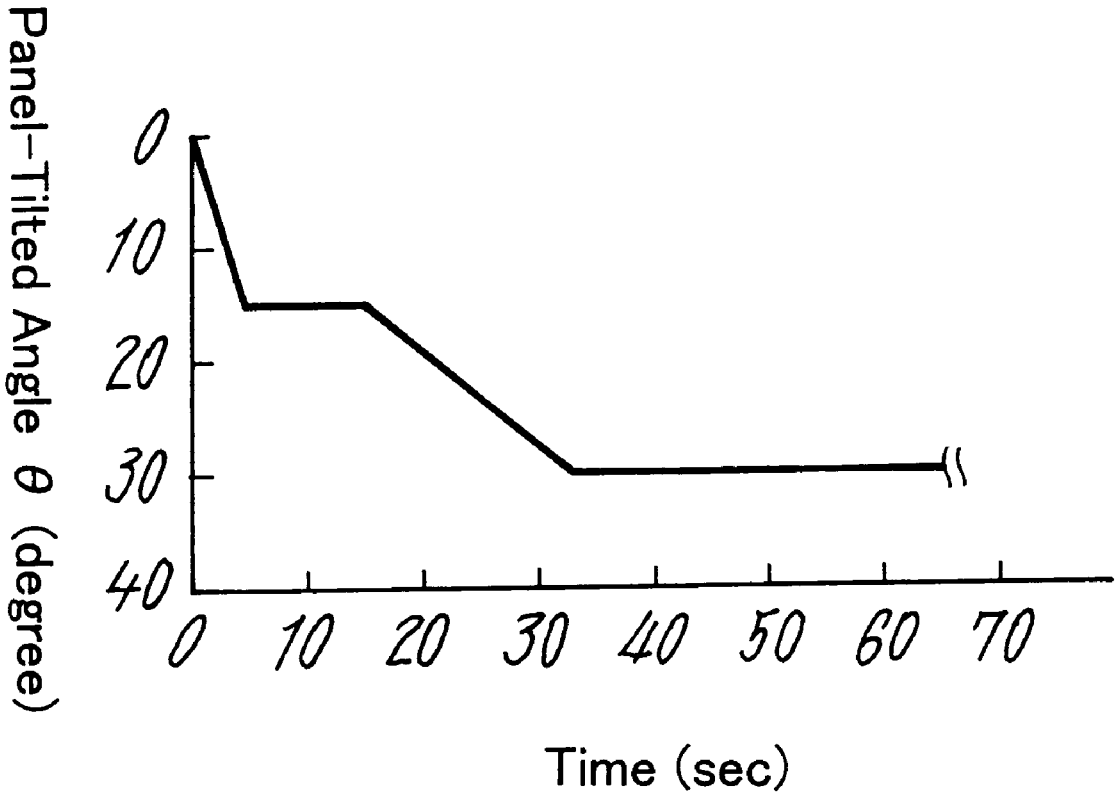
FIG. 7 is a graph showing the relationship between time and a panel tilt angle θ in the application process according to a third embodiment of the present invention.

In this embodiment, an application process is carried out employing schedules shown in FIGS. 6 and 7. FIGS. 6 and 7 show the manners of changing a panel rotation speed and a panel-tilt angle θ respectively as time elapses in the application process.

A first application step employs a panel-tilt angle θ of 15° and a panel rotation speed of 33 rpm. In order to spread a phosphor slurry 9 over as wide an area as possible on an inner face of a glass panel and to prevent unevenness of the phosphor slurry 9 radially toward the periphery of the glass panel, the panel rotation speed is preferably 30–40 rpm, and the optimum speed is around 33 rpm. Too wide panel-tilt angle θ causes foam generation due to rapid liquid flow. On the contrary, when the panel-tilt angle θ is too narrow, the phosphor slurry 9 does not spread over the inner face of the glass panel sufficiently. Therefore, the panel-tilt angle θ is preferably about 10°–20°, and the optimum angle θ is around 15°.

In a second application step, while changing the panel-tilt angle θ from 15° to 30° continuously, the panel rotation speed is changed to 10 rpm. Further, in a third application step, while keeping the panel-tilt angle θ of 30° unchanged, the panel rotation speed is decreased to 5 rpm.

A subsequent shake-off process employs a panel-tilt angle θ of 110° and a panel rotation speed of 170 rpm.

A subsequent drying process and the further process are the same as in the first embodiment. Thus a phosphor screen is formed.

Fourth Embodiment

In this embodiment, an application process is carried out according to the schedules shown in FIGS. 6 and 7 as in the third embodiment and a shake-off process is carried out in two steps as in the second embodiment.

A first shake-off step employs a panel-tilt angle θ of 50° and a panel rotation speed of 110 rpm. A second shake-off step employs a panel-tilt angle θ of 110° and a panel rotation speed of 170 rpm.

A subsequent drying process and the further process are the same as in the first embodiment. Thus a phosphor screen is formed.

Evaluation of the Phosphor Screen

In the glass panel on which a phosphor screen had been formed in each embodiment described above, appearance of the phosphor screen (an application pattern, a condition that a phosphor slurry sticks around a pin, a staining condition on an inner wall, liquid spill from the corner cups) was evaluated. The weight distribution (the ratio of the center portion and the peripheral portion) of the phosphor screen was then evaluated. The luminance, luminance variation, color difference and the like were measured by making the finished samples (finished bulbs) emit light experimentally. With regard to the results of the evaluation and measurement mentioned above, Table 1 shows the evaluation results of the application pattern, the condition that a phosphor slurry sticks around a pin, the staining condition on an inner-wall, the liquid spill from the corner cups and the weight distribution (the ratio of the center portion and the peripheral portion) of the phosphor screen and Table 2 shows the measurement results of the luminance of the finished bulbs.

TABLE 1

| | Application Pattern | Phosphor-Slurry Sticking Around Pin | Wall Stain | Liquid Spill | Phosphor-Screen Weight Distribution (%) |
|---|---|---|---|---|---|
| First Embodiment | ○ | Δ | Δ | ○ | 89 |
| Second Embodiment | ○ | ○ | ○ | ○ | 91 |
| Third Embodiment | Δ | Δ | ○ | ○ | 92 |
| Fourth Embodiment | ○ | ○ | ○ | ○ | 94 |
| First Comparative Example | Δ | Δ | x | x | 84 |
| Second Comparative Example | Δ | ○ | x | x | 81 |
| Third Comparative Example | x | ○ | ○ | Δ | 82 |

TABLE 2

| | $W_{Br}$ (cd/m$^2$) | $W_B$ (cd/m$^2$) | $W_{cr}$ (%) |
|---|---|---|---|
| First Embodiment | 63.8 | 109.1 | 91 |
| Second Embodiment | 62.9 | 103.2 | 92 |
| Third Embodiment | 63.3 | 105.3 | 94 |
| Fourth Embodiment | 64.1 | 108.0 | 97 |
| First Comparative Example | 61.1 | 101.2 | 82 |
| Second Comparative Example | 63.0 | 105.3 | 81 |
| Third Comparative Example | 59.2 | 99.2 | 81 |

In the first to third comparative examples, a phosphor screen was formed under the following conditions.

In the first comparative example, the phosphor screen was formed under the same conditions as in the first embodiment except for the rotation speed of 13 rpm in the first and second application steps and the constant panel-tilt angle θ of 110° in the drying process. In this comparative example, adhesion of green phosphors onto other color holes hardly was found. However, a phosphor slurry was spattered from corner cups in the drying process, thus causing a strong phenomenon that the phosphor slurry sticks around a pin and intensive wall stain. A few blue and red phosphor particles adhering to back faces of green phosphors were found per a length of 200 μm. However, the red phosphors adhering to back faces of the blue phosphors were at the same level as in the first embodiment.

In the second comparative example, the phosphor screen was formed under the same conditions as in the first embodiment except for the rotation speed of 13 rpm in the first and second application steps and the constant panel rotation speed of 110 rpm in the drying process. In this comparative example, in forming a blue phosphor screen and a red phosphor screen, a weak cross phenomenon and a strong cross phenomenon were also found on an exposure platform respectively. About one or two blue and red phosphor particles adhering to back faces of green phosphors were found per a length of 200 $\mu$m. However, the red phosphors adhering to back faces of the blue phosphors were in the same level as in the first to fourth embodiments.

In the third comparative example, the phosphor screen is formed under the same conditions as in the first embodiment except for the rotation speed of 13 rpm in the first and second application steps and the constant panel-tilt angle $\theta$ of 25° in the shake-off process. After a drying process, the phosphor screen in this example had an uneven center portion on a panel and bad application weight distribution. About one to three blue and red phosphor particles adhering to back faces of green phosphors were found per a length of 200 $\mu$m. However, the red phosphors adhering to back faces of the blue phosphors were in the same level as in the first to fourth embodiments.

The characteristics of the phosphor screens obtained in the first to fourth embodiments will be explained as compared with the comparative examples mentioned above as follows.

In Table 1, a column "Application Pattern" shows an unevenness condition of the phosphor screen surface formed on the glass panel after the application and drying processes. A column "Phosphor-Slurry Sticking Around Pin" shows a sticking level of the phosphor slurry around a pin for mounting a mask in forming the screen. A column "Wall Stain" shows a staining level of an inner wall by the spattered phosphor slurry. A column "Liquid Spill" shows a spattering level of the recovered phosphor slurry from corner cups to the outside. Each condition is evaluated in three levels with marks ○, Δ, and X, wherein ○, Δ, and X indicate good, fair, and bad, respectively.

A column "Phosphor-Screen Weight Distribution" shows the weight ratio of a phosphor screen at the peripheral portion and the center portion of a glass panel. Basically, it is desirable that the phosphor-screen weight distribution be 100% over the entire area of the phosphor screen. It is necessary to obtain at least about 85% at the peripheral portion with respect to the center portion (100%). Therefore, the phosphor-screen weight distribution in the range of about 90–110% can be defined as a better condition.

In Table 2, $W_{Br}$ indicates a white practical luminance (cd/m$^2$), and $W_B$ indicates white emission efficiency (cd/m$^2$). Further, a luminance ratio $W_{cr}$ (%) of the peripheral portion of the glass panel with respect to the center portion of 100% also is indicated as luminance variation. In order to restrain the decrease in luminance at the peripheral portion with respect to the center portion as little as possible, the luminance ratio of the peripheral portion is preferably 90–105%.

As described above, upon comparing each embodiment and each comparative example, as is apparent from the evaluation and measurement results, with the present invention, a uniform phosphor screen with an excellent application pattern can be formed. In addition, a cathode-ray tube having excellent white quality, a high luminance, and low unevenness in luminance can be obtained.

In each embodiment described above, a 41-cm glass panel with a transmission of 52% was used. However, the glass panel is not limited to this. When using a glass panel having another transmission or size, the same effect as in the present embodiments can be obtained by employing the methods of the present invention through adjusting the kind of a coating film on the surface of the glass panel, an injection volume of the phosphor slurry from the application nozzle, the panel rotation speed in each process, and the like.

The phosphors having a particle size of 8 $\mu$m were used for the phosphor slurry in the present embodiments. Considering the emission efficiency, the larger the particle size is, the more it is preferable. However, phosphors having a small particle size of 4 $\mu$m or the like also can be used.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of manufacturing a cathode-ray tube having a process of forming a phosphor screen, the process comprising:

an application process in which a phosphor slurry is injected onto an inner face of a glass panel and the glass panel is tilted with respect to a vertical axis and is rotated to spread the phosphor slurry over almost an entire area of the inner face of the glass panel;

a shake-off process in which by rotating the glass panel with a tilt, excess phosphor slurry is shaken off, and the phosphor slurry is recovered in phosphor-slurry recovery members provided at corners of the glass panel; and a drying process in which by rotating the glass panel with a tilt, the phosphor slurry applied onto the inner face of the glass panel is dried, wherein the application process comprises:

a first application step in which the glass panel is rotated at a predetermined tilt angle and a predetermined rotation speed;

a second application step subsequent to the first application step in which the glass panel is rotated at a wider tilt angle than that in the first application step and a lower rotation speed than that in the first application step; and a third application step subsequent to the second application step in which the glass panel is rotated at a lower rotation speed than that in the second application step.

2. The method of manufacturing a cathode-ray tube according to claim 1, wherein the glass panel has a tilt angle of 5°–20° in the first application step.

3. The method of manufacturing a cathode-ray tube according to claim 1, wherein the shake-off process comprises:

a first shake-off step in which the glass panel is rotated at a predetermined tilt angle and a predetermined rotation speed; and a second shake-off step subsequent to the first shake-off step in which the glass panel is rotated at a wider tilt angle than that in the first shake-off step and a higher rotation speed than that in the first application step, and the drying process comprises:

a first drying step in which the glass panel is rotated at a predetermined tilt angle and a predetermined rotation speed; and a second drying step subsequent to the first drying step in which the glass panel is rotated at a rotation speed equal to or higher than that in the first application step.

4. The method of manufacturing a cathode-ray tube according to claim 1, wherein each phosphor slurry recovery member is a box-shaped object with an opening and turn-up portions toward the inside of the box-shaped object at the edge of the opening.

5. The method of manufacturing a cathode-ray tube according to claim 1, wherein the shake-off process comprises:

a first shake-off step in which the glass panel is rotated at a predetermined tilt angle and a predetermined rotation speed; and a second shake-off step subsequent to the first shake-off step in which the glass panel is rotated at a wider tilt angle than that in the first shake-off step and a higher rotation speed than that in the first application step.

6. A method of manufacturing a cathode-ray tube having a process of forming a phosphor screen, the process comprising:

an application process in which a phosphor slurry is injected onto an inner face of a glass panel and the glass panel is tilted with respect to a vertical axis and is rotated to spread the phosphor slurry over almost an entire area of the inner face of the glass panel;

a shake-off process in which by rotating the glass panel with a tilt, excess phosphor slurry is shaken off, and the phosphor slurry is recovered in phosphor-slurry recovery members provided at corners of the glass panel; and a drying process in which by rotating the glass panel with a tilt the phosphor slurry applied onto the inner face of the glass panel is dried, wherein the shake-off process comprises:

a first shake-off step in which the glass panel is rotated at a predetermined tilt angle and a predetermined rotation speed; and a second shake-off step subsequent to the first shake-off step in which the glass panel is rotated at a wider tilt angle than that in the first shake-off step and a higher rotation speed than that in the application process.

7. The method of manufacturing a cathode-ray tube according to claim 6, wherein the glass panel has a tilt angle of 40°–80° and a rotation speed of 100–150 rpm in the first shake-off step and the glass panel has a tilt angle of 65°–115° and a rotation speed of 150–250 rpm in the second shake-off step.

8. The method of manufacturing a cathode-ray tube according to claim 6, wherein each phosphor slurry recovery member is a box-shaped object with an opening and turn-up portions toward the inside of the box-shaped object at the edge of the opening.

9. The method of manufacturing a cathode-ray tube according to claim 6, wherein the drying process comprises:

a first drying step in which the glass panel is rotated at a predetermined tilt angle and a predetermined rotation speed; and a second drying step subsequent to the first drying step in which the glass panel is rotated at a rotation speed equal to or higher than that in the first application step.

10. A method of manufacturing a cathode-ray tube having a process of forming a phosphor screen, the process comprising:

an application process in which a phosphor slurry is injected onto an inner face of a glass panel and the glass panel is tilted with respect to a vertical axis and is rotated to spread the phosphor slurry over almost an entire area of the inner face of the glass panel;

a shake-off process in which by rotating the glass panel with a tilt, excess phosphor slurry is shaken off, and the phosphor slurry is recovered in phosphor-slurry recovery members provided at comers of the glass panel; and a drying process in which by rotating the glass panel with a tilt, the phosphor slurry applied onto the inner face of the glass panel is dried, wherein the drying process comprises:

a first drying step in which the glass panel is rotated at a predetermined tilt angle and a predetermined rotation speed; and a second drying step subsequent to the first drying step in which the glass panel is rotated at a rotation speed equal to or higher than that in the application process.

11. The method of manufacturing a cathode-ray tube according to claim 10, wherein the glass panel has a tilt angle of 85°–95° and a rotation speed of 30–70 rpm in the first drying step and the glass panel has a tilt angle of 85°–95° and a rotation speed of 70–95 rpm in the second drying step.

12. The method of manufacturing a cathode-ray tube according to claim 10, wherein each phosphor slurry recovery member is a box-shaped object with an opening and turn-up portions toward the inside of the box-shaped object at the edge of the opening.

13. The method of manufacturing a cathode-ray tube according to claim 10, wherein the application process comprises:

a first application step in which the glass panel is rotated at a predetermined tilt angle and a predetermined rotation speed;

a second application step subsequent to the first application step in which the glass panel is rotated at a wider tilt angle than that in the first application step and a lower rotation speed than that in the first application step; and a third application step subsequent to the second application step in which the glass panel is rotated at a lower rotation speed than that in the second application step.

* * * * *